United States Patent [19]

Sonobe et al.

[11] Patent Number: 5,000,690

[45] Date of Patent: Mar. 19, 1991

[54] ELECTRICAL CONNECTOR FOR MODULE PACKAGING

[75] Inventors: Toshimitsu Sonobe, Tokyo; Masahiro Yamamoto, Yokohama, both of Japan

[73] Assignee: Thomas & Betts Corporation, Bridgewater, N.J.

[21] Appl. No.: 415,166

[22] Filed: Sep. 28, 1989

[30] Foreign Application Priority Data

Sep. 30, 1988 [JP] Japan ..... 63-244682

[51] Int. Cl.[5] ..... H01R 9/09

[52] U.S. Cl. ..... 439/76; 361/395; 439/354

[58] Field of Search ..... 439/59–62, 439/76, 79, 80, 354; 361/395, 399, 412, 413, 415

[56] References Cited

U.S. PATENT DOCUMENTS

| | | | |
|---|---|---|---|
| 3,380,016 | 4/1968 | Samson et al. | 339/174 |
| 3,443,160 | 5/1969 | Salera | 361/395 |
| 3,573,617 | 4/1971 | Randolph et al. | 324/158 |
| 3,599,046 | 10/1971 | Spreitzer | 361/412 |
| 3,668,604 | 6/1972 | Rossman | 339/17 CF |
| 3,805,212 | 4/1974 | Landman et al. | 439/61 |
| 3,871,736 | 3/1975 | Carter | 339/221 R |
| 3,877,064 | 4/1975 | Scheingold et al. | 357/74 |
| 4,218,724 | 8/1980 | Kaufman | 439/74 |
| 4,508,398 | 4/1985 | Stepan et al. | 439/65 |
| 4,699,593 | 10/1987 | Grabbe et al. | 439/71 |
| 4,768,972 | 9/1988 | Ignasiak et al. | 439/330 |
| 4,786,256 | 11/1988 | Angeleri et al. | 439/72 |
| 4,899,256 | 2/1990 | Sway-Tin | 361/399 |

*Primary Examiner*—Neil Abrams

*Attorney, Agent, or Firm*—Robert M. Rodrick; Salvatore J. Abbruzzese

[57] ABSTRACT

An electrical connector, described for suitably connecting electronic packages to each other or an electrical package to electrical wires. In a preferred form, the connector comprises a plurality of first contacts supported by an insulative housing, the housing having opposite surfaces adjacent which exposed portions of the first contacts lie. The exposed contact portions are attached to electrically engage two respective printed circuit boards on the top and bottom of the connector. Additionally, a further set of contacts is provided, which contacts include an exposed portion adjacent one of the housing supporting surfaces and a terminal portion disposed substantially parallel to such supporting surfaces for electrical engagement to a terminated wire.

3 Claims, 5 Drawing Sheets

ELECTRICAL CONNECTOR FOR MODULE PACKAGING

FIELD OF THE INVENTION

The present invention relates to a module connector for suitably connecting, e.g., electronic packages to each other or an electronic package to wires.

BACKGROUND OF THE INVENTION

Electronic packages (e.g., printed circuit boards) mounted with a large number of electronic components have been used in a variety of industrial fields. Depending on the application fields, electronic packages are connected to each other through a connector, or an electronic package is connected to wires through a connector to produce an electronic package module.

A conventional connector of this type is exemplified by a socket for surface-mounting integrating circuits. However, the application fields of such sockets are limited, and the sockets do not provide sufficient versatility.

SUMMARY OF THE INVENTION

The present invention has been developed in consideration of the above situation, and has as an object to provide a connector for allowing production of a unit by surface-mounting various electronic packages and connecting electronic packages to wires.

In accordance with the invention there is provided a connector comprising first contacts to be brought into electrical contact with a first member and an insulative housing for holding the first contacts. The housing includes a first support surface for supporting the first member, portions of the first contacts being exposed on the first support surface of the housing so as to be brought into electrical contact with the first member. The first contacts further include terminal portions which are to be respectivley brought into electrical contact with second members, the terminal portions being provided with portions substantially parallel to the first support surface.

DETAILED DESCRIPTION OF THE PREFERRED EMBODIMENT

Figure 1:
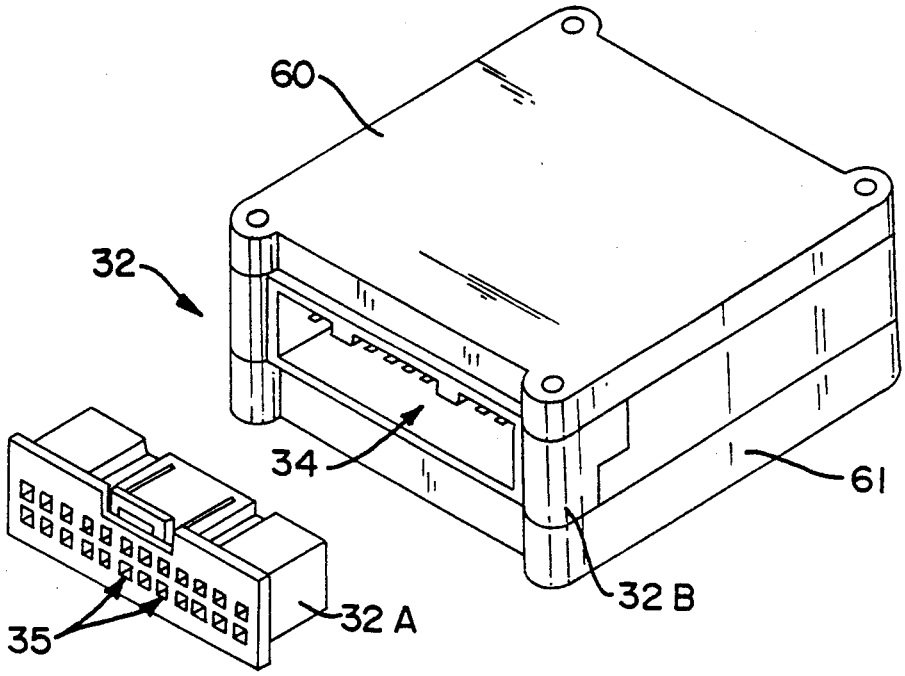
FIG. 1 is an exploded perspective view showing a portion of the connector of the present invention in use.
Figure 2:
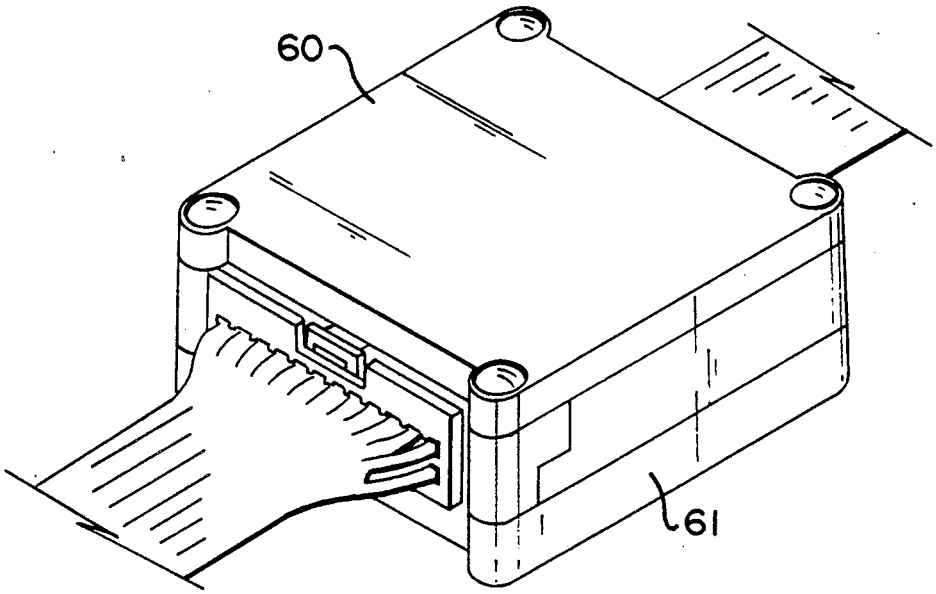
FIG. 2 is a perspective view showing the overall structure in use.

Referring to the drawings, FIGS. 1 and 2 show an electronic package module using a connector according to the present invention.

In FIGS. 1 and 2, reference numeral 32A denotes a plug housing portion as one constituting a member of a housing of the connector of the present invention. Reference numeral 32B denotes a cap housing portion as the other constituting member. The plug housing 32A is stored in a storage cavity 34 formed in the cap housing 32B.

Figure 3:
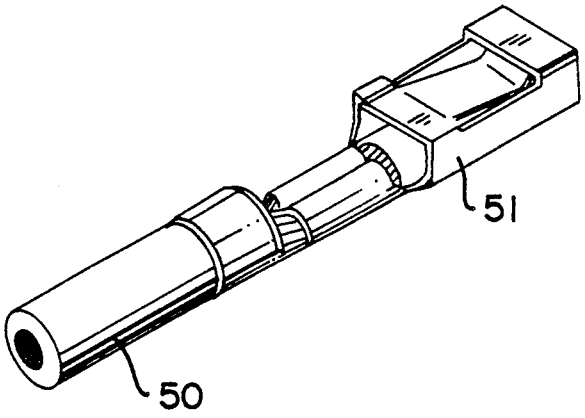
FIG. 3 is a perspective view showing a terminated wire to be connected by the connector of the present invention.

Holes 35 for receiving end portions (conductive receptacle contacts) 51 of connecting components 50 (wires) shown in FIG. 3 are formed in the plug housing 32A. The end portions 51 of the wires 50 stored in the holes 35 are respectively electrically connected to first contacts (to be described subsequently) mounted inside the housing.

Reference numerals 60 and 61 denote casings each constituted by, e.g., an aluminum case.

Figure 4:
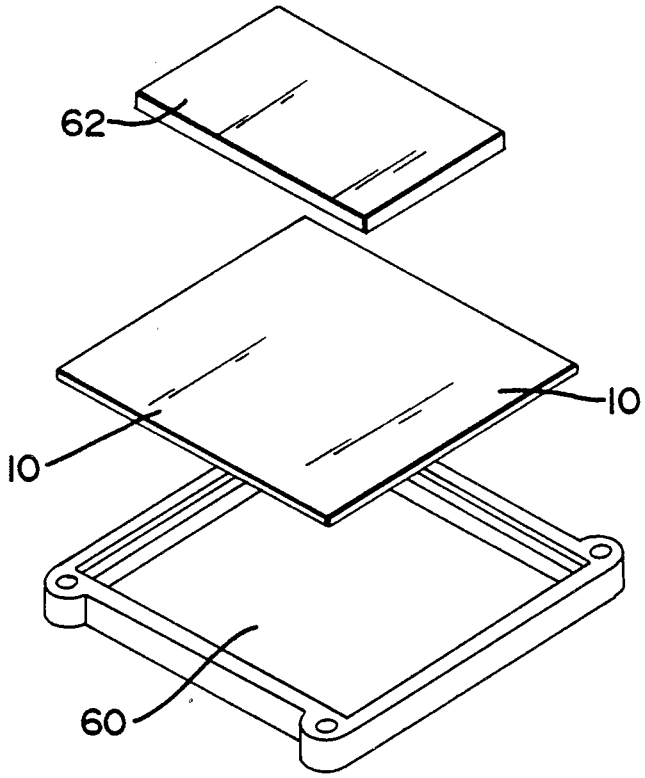
FIG. 4 is an exploded perspective view showing an electronic package unit to be connected by the connector of the present invention.

FIG. 4 shows a unit assembly supported on the upper portion of the housing 32 of FIG. 1 and electrically connected to contacts (to be described in detail) of the housing.

Referring to FIG. 4, reference numeral 62 denotes one of electronic components (e.g., a resistor, a capacitor, an IC, or a transistor). Reference numeral 10 denotes a printed circuit board on which the electronic components 62 are mounted; 60, the aluminum case.

A conductive pattern (denoted by reference numeral 11 in FIG. 8 to be described) is formed on a peripheral portion of the printed circuit board 10 and is brought into contact with the contacts mounted in the housing.

The aluminum case 60 shields the unit assembly from external electrostatic components and dissipates heat generated by the unit assembly.

Figure 5:
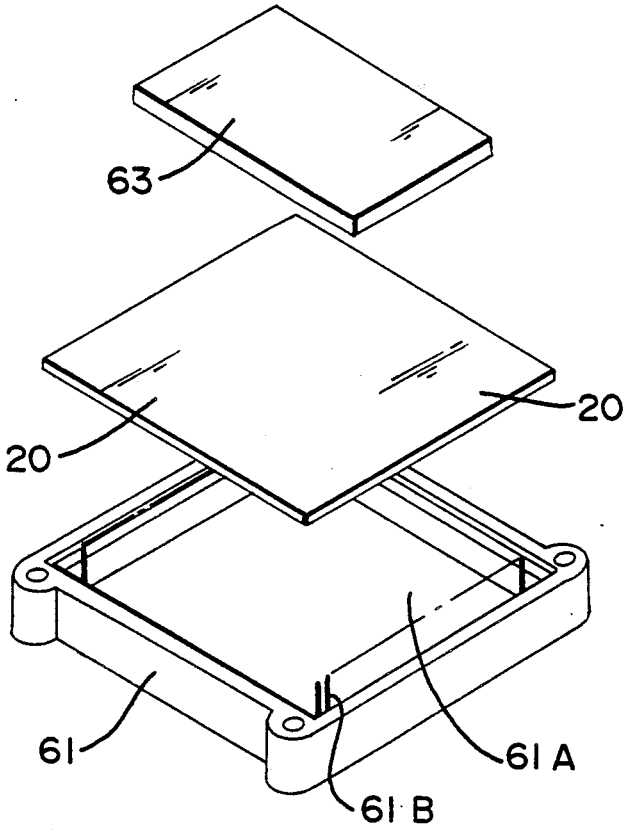
FIG. 5 is an exploded perspective view of a further electronic package unit.

FIG. 5 shows the unit assembly located in the lower portion of the housing and electrically connected to contacts of the housing.

Referring to FIG. 5, reference numeral 63 denotes one of electronic components; 20, a printed circuit board on which the electronic components are mounted; and 61, the aluminum case.

A conductive pattern (denoted by reference numeral 21 in FIG. 8) is formed on the peripheral portion of the printed circuit board 10 and is brought into contact with contacts mounted in the housing.

Figure 8:
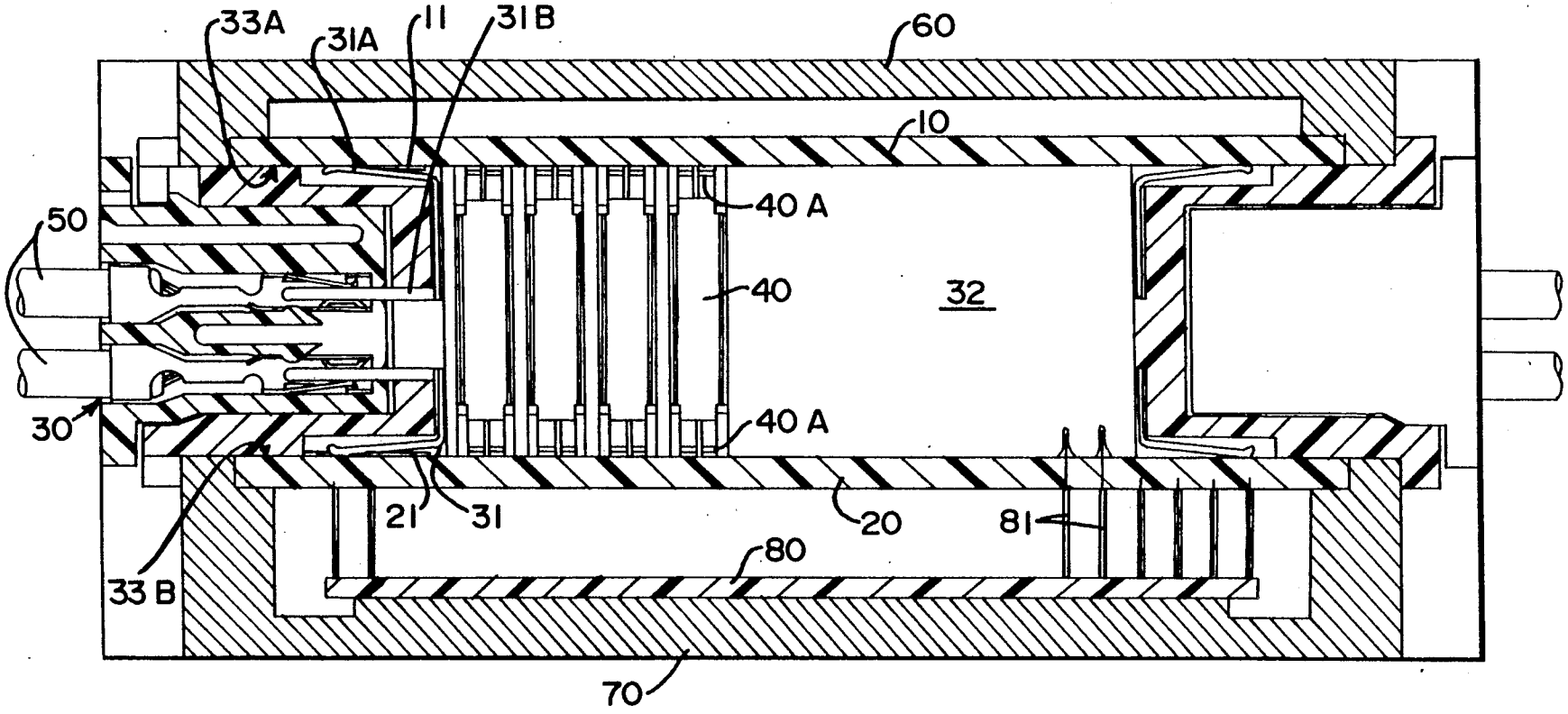
FIG. 8 is a sectional view showing an application of the present invention.

Another electronic package 80 (e.g., a ceramic substrate on which a power IC is mounted is arranged at the bottom portion of the case 61, as shown in FIG. 8. The electronic package 80 is connected to the printed circuit board 20 through a jumper lead 81.

Figure 6:
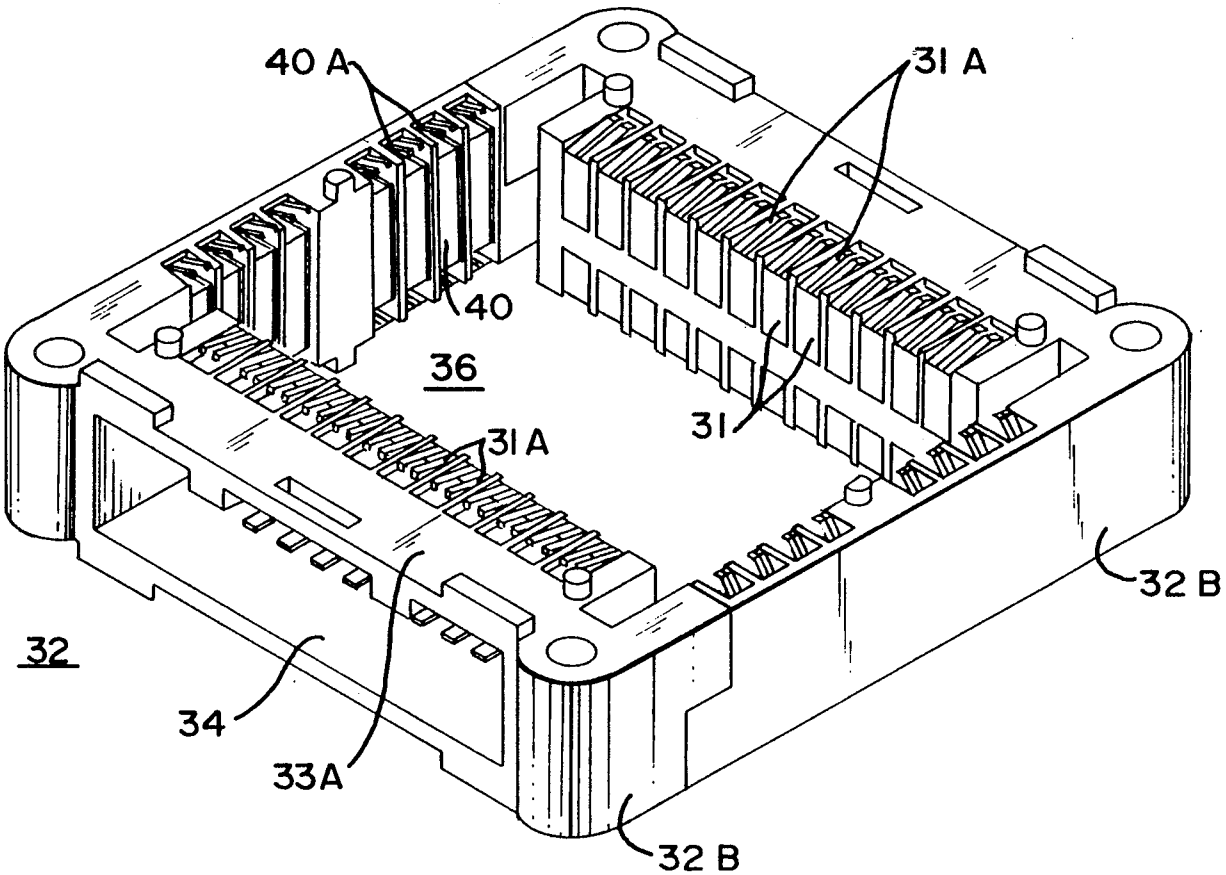
FIG. 6 is a perspective view showing a housing according to an embodiment of the present invention.

FIG. 6 shows one embodiment of the housing 32 according to the present invention. The housing 36 is constituted by a pair of L-shaped housing members 32B to form an internal opening 36.

The housing 32 is made of a plastic material and holds first contacts 31 which are to be electrically brought into contact with the first member 10 (printed circuit board) to be connected.

The housing 32 comprises a first support surface 33A for supporting the first member.

The first contacts 31 are exposed adjacent the first support surface 33A of the housing so that portions 31A of the contacts 31 are electrically connected to the first member 10.

In the illustrated embodiment, the housing 32 supports the first contacts 31 so that the portions 31A are exposed outside the housing.

The first contacts 31 also comprise terminal portions 31B (FIG. 8) which are to be electrically connected to second members 50 (wires) to be connected. The terminal portions 31B have portions substantially parallel to the first support surface 33A so as to electrically connect the terminal portions 31B to the second members 50 (wires).

In the illustrated embodiment, the first contacts 31 comprise L-shaped members, respectively, and their legs are secured in the housing 32.

The housing 32 further comprises a second support surface 33B (FIG. 8) for supporting a third member 20 (a printed circuit board; FIGS. 8 and 5) to be connected.

The housing further holds second contacts 40 (FIGS. 8 and 7) for electrically connecting the first and third members 10 and 20.

The second contacts are exposed on the first and second support surfaces 33A and 33B such that portions 40A (FIGS. 8 and 6) of the second contacts are electrically connected to the first and third members 10 and 20.

In the illustrated embodiment, the portions 31A and 40A of the first and second contacts 31 and 40 which are brought into contact with the first and third members 10 and 20 are constituted by spring portions, respectively.

Figure 7:
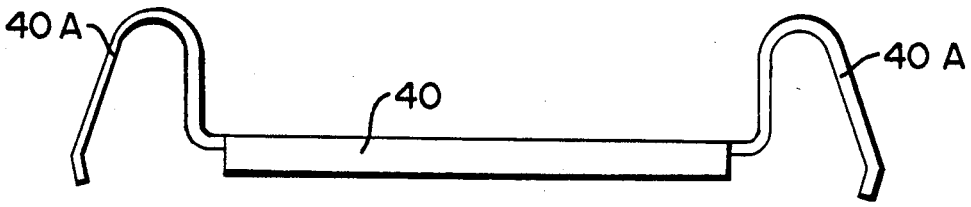
FIG. 7 is a side elevation view of a contact in accordance with a preferred arrangement of the electrical connector.

FIG. 7 shows a detailed arrangement of each second contact.

FIG. 8 shows an electronic package module in which the printed circuit boards 10, 20 and 80 and the wires 50 are electrically connected by using the connector of the present invention. The respective components have been described above.

When the connector of the present invention is used, the housing becomes part of the unit to achieve compactness and a high packing density.

The housing of the connector is constituted by a combination of housing members having an identical shape. Therefore, the number of components is small, and assembly without minimized errors can be facilitated.

Since no solder is used in the connector of the present invention, the connector can be detachably connected to the member to be connected. As such, contact lead portions for soldering can be omitted to obtain a more compact structure.

We claim:

1. An electrical connector comprising first contacts (31) for electrical contact with a first member (10) and an insulative housing (32) supporting said first contacts, said housing (32)) including a first support surface (33A) for supporting said first member, said first contacts (31) having portions (31A) exposed adjacent said first support surface (33A) of said housing so as to be brought into electrical contact with said first member, said first contacts (31) further including terminal portions (31B) which are to be brought into electrical contact with second members (50), said terminal portions (31B) including portions substantially parallel to said first support surface (33A), said housing (32) including a second support surface (33B) for supporting a third member (20) and supporting second contacts (40) for electrically connecting said first member (10) to said third member (20), said second contacts (40) including contact portions (40A) which are to be brought into electrical contact with said first and third members, said contact portions (40A) being exposed adjacent said first and second support surfaces (33A) and (33B), said housing (32) comprising a pair of generally L-shaped housing members forming ann internal opening (36), said housing (32) including a plug portion (32A) having a plurality of holes for respectively receiving end portions (51) of said second members (50) for connection to said first contacts, said housing (32) having a storage cavity (34) receiving said plug portion therein, said first contacts (31) extending from the exterior of said housing into said storage cavity.

2. An electrical connector according to claim 1 wherein said housing supports said first contacts (31) such that said portions (331) of said first contacts which are to be brought into contact with said first and third members are exposed exteriorly of said housing.

3. An electrical connector according to claim 2, wherein said contact portions (31A) and (40A) which are to be brought into contact with aid first and third members are formed of spring elements, respectively.

* * * * *